US010480254B2

(12) United States Patent
Lyons

(10) Patent No.: US 10,480,254 B2
(45) Date of Patent: Nov. 19, 2019

(54) DRILL BITS HAVING TAILORED DEPTH OF CUT CONTROL FEATURES AND RELATED METHODS

(71) Applicant: Baker Hughes, a GE company, LLC, Houston, TX (US)

(72) Inventor: Nicholas J. Lyons, Houston, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 246 days.

(21) Appl. No.: 15/642,618

(22) Filed: Jul. 6, 2017

(65) Prior Publication Data

US 2019/0010764 A1 Jan. 10, 2019

(51) Int. Cl.

| | |
|---|---|
| ***E21B 10/43*** | (2006.01) |
| ***E21B 10/42*** | (2006.01) |
| ***E21B 10/62*** | (2006.01) |
| ***E21B 10/567*** | (2006.01) |

(52) U.S. Cl.

CPC ..... *E21B 10/62* (2013.01); *E21B 10/42* (2013.01); *E21B 10/567* (2013.01); *E21B 10/5673* (2013.01)

(58) Field of Classification Search

CPC ..... E21B 10/43; E21B 10/42; E21B 10/62
See application file for complete search history.

(56) References Cited

U.S. PATENT DOCUMENTS

| | | | | |
|---|---|---|---|---|
| 7,814,997 | B2 | 10/2010 | Aliko et al. | |
| 7,836,979 | B2 * | 11/2010 | Green | E21B 10/43 175/428 |
| 8,505,634 | B2 | 8/2013 | Lyons et al. | |
| 8,584,776 | B2 * | 11/2013 | Radford | E21B 10/26 175/334 |
| 8,794,356 | B2 | 8/2014 | Lyons et al. | |
| 9,022,149 | B2 | 5/2015 | Lyons | |
| 9,074,435 | B2 | 7/2015 | Scott et al. | |
| 2010/0276200 | A1 | 11/2010 | Schwefe et al. | |
| 2011/0192651 | A1 | 8/2011 | Lyons et al. | |

(Continued)

FOREIGN PATENT DOCUMENTS

WO 2016/153499 A1 9/2016

OTHER PUBLICATIONS

International Written Opinion for International Application No. PCT/US2018/040885 dated Nov. 13, 2018, 6 pages.

(Continued)

*Primary Examiner* — Catherine Loikith
(74) *Attorney, Agent, or Firm* — TraskBritt

(57) ABSTRACT

An earth-boring tool comprises a bit body and first and second depth of cut control ("DOCC") features mounted thereon. The first and second DOCC features comprise a first rubbing surface having a first surface area and a second rubbing surface having a second surface area, respectively, for contacting a subterranean formation. The second surface area is different from the first surface area such that the first and second DOCC features distribute a load attributable to applied weight on bit over the first and second rubbing surfaces at different rates. Methods of forming an earth-boring tool include selecting first and second DOCC features having different rates of engagement with the subterranean formation and mounting the first and second DOCC features on a bit body.

17 Claims, 9 Drawing Sheets

(56) References Cited

U.S. PATENT DOCUMENTS

| | | | |
|---|---|---|---|
| 2013/0081880 | A1 | 4/2013 | Schwefe et al. |
| 2015/0198029 | A1 | 7/2015 | Chen |
| 2016/0053547 | A1 | 2/2016 | Samuel et al. |

OTHER PUBLICATIONS

International Search Report for International Application No. PCT/US2018/040885 dated Nov. 13, 2018, 4 pages.

* cited by examiner

DRILL BITS HAVING TAILORED DEPTH OF CUT CONTROL FEATURES AND RELATED METHODS

TECHNICAL FIELD

The present disclosure, in various embodiments, relates generally to earth-boring tools including depth of cut control features and to methods of designing and making such earth-boring tools.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit.

The cutting elements used in such earth-boring tools often include polycrystalline diamond compact cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes.

During drilling, fixed-cutter drill bits are sometimes momentarily stopped from rotating at the bottom of the wellbore due to fluctuations in weight on bit (WOB) or transitions between different subterranean formations, which stoppage results in rapidly increasing torque on the bit due to continued drill string rotation or rotation by a downhole motor. Once the torque on the bit reaches a threshold level, the bit will slip back into rotation resulting in a decrease in the torque on the bit. The bit can oscillate between such sticking and slipping at a relatively high frequency, and such oscillation may be manifested in the form of vibrations in the drill string. This phenomenon is known in the art as "stick-slip."

Stick-slip vibrations of drill strings have been studied by researchers for several decades. The subject is gaining renewed interest as operating parameters for PDC bits have shifted to the stick-slip regime of higher bit weight and lower rotary speed for enhanced drilling performance. Stick-slip has been identified in the art as a significant cause of bit damage. Various theories for mitigating stick-slip have been set forth in the art. Although the phenomenological basis of these theories has been provided, validation in most cases is based on anecdotal evidence from the field. Data with diagnosis based on down-hole measurements in a controlled environment has been relatively limited. Consequently, conflicting opinions continue to exist about the validity of the various theories set forth in the art for mitigation of stick-slip.

The phenomena of drilling vibrations have been actively pursued by researchers for a long time as they can result in the failure of bits and BHA components and lead to increased drilling costs due to non-productive time (NPT) and reduced efficiency. For the past two decades, much of the attention in the art to reduction of drill string vibrations has been given to combating backward whirl through anti-whirl bit designs. Meanwhile, cutter technology has progressed dramatically with much more impact and abrasion-resistant, thermally stable PDC cutters. Consequently, the operating parameters for PDC bits have gradually shifted to higher weight on bit (WOB) and lower rotary speed for enhanced drilling performance.

In view of the above, mitigation of stick-slip vibrations is gaining a renewed interest in the art.

BRIEF SUMMARY

In some embodiments, an earth-boring tool for drilling subterranean formations comprises a bit body having a central axis. The bit body may have first and second depth of cut control ("DOCC") features mounted thereon. The first DOCC feature comprises a first rubbing surface having a first surface area for contacting a subterranean formation and distributing a load attributable to applied weight on bit at a first rate of engagement. The second DOCC feature comprises a second rubbing surface having a second surface area for contacting the subterranean formation and distributing the load attributable to applied weight on bit at a second rate of engagement. The second surface area is different from the first surface area such that the second rate of engagement is different from the first rate of engagement.

In other embodiments, a method of forming an earth-boring tool comprises selecting a first DOCC feature to contact a subterranean formation and distribute a load attributable to applied weight on bit over a first rubbing surface at a first rate of engagement and selecting a second DOCC feature to contact the subterranean formation and distribute a load attributable to applied weight on bit over a second rubbing surface at a second rate of engagement. The first rate of engagement is selected to be greater than the second rate of engagement. The first DOCC feature and the second DOCC feature are mounted on a bit body of the earth-boring tool.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
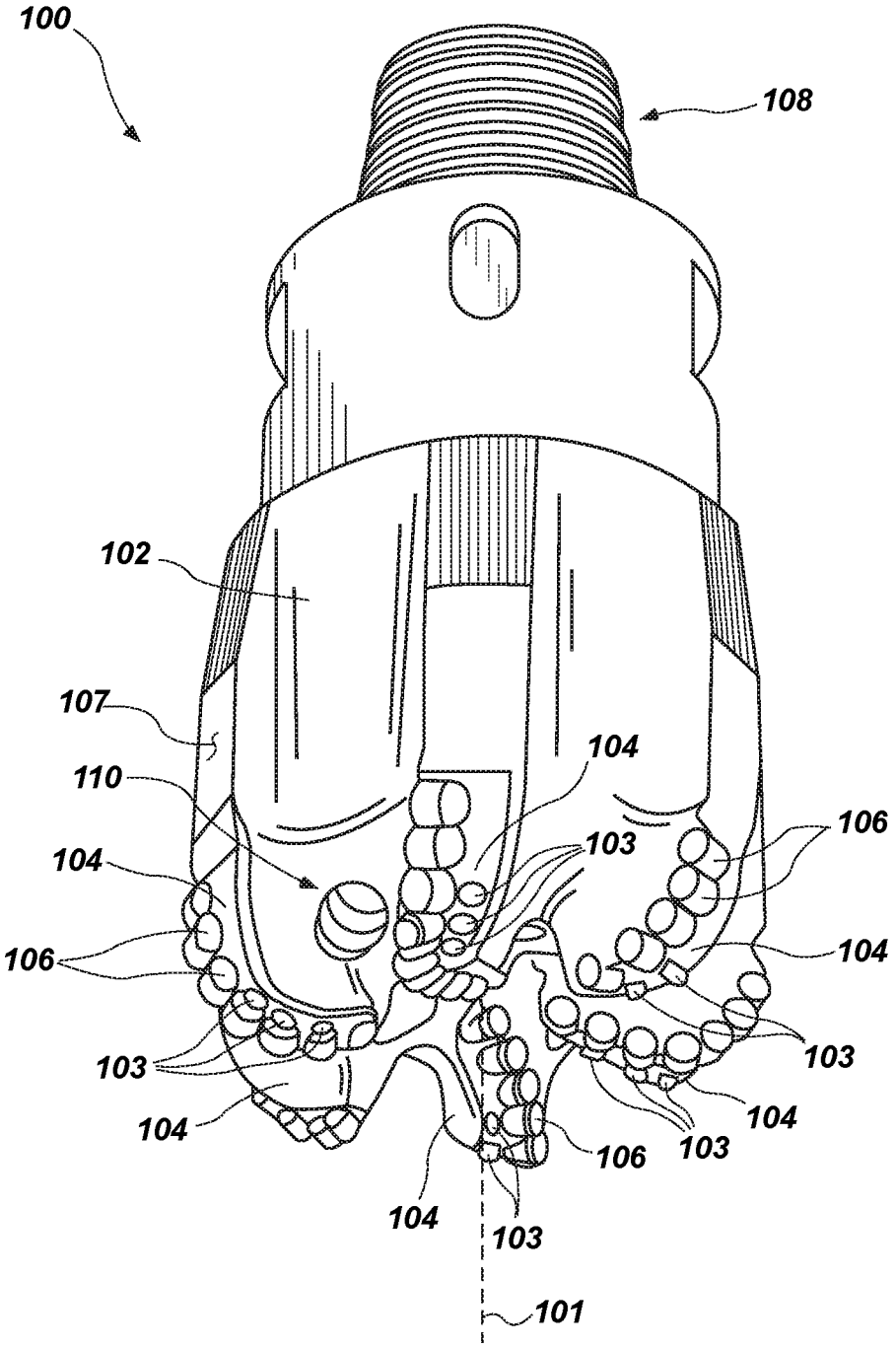
FIG. 1 illustrates an earth-boring rotary drill bit that may be designed and fabricated in accordance with embodiments of the present disclosure.

The illustrations presented herein are not meant to be actual views of any particular cutting structure, drill bit, or component thereof, but are merely idealized representations that are employed to describe embodiments of the present disclosure. For clarity in description, various features and elements common among the embodiments may be referenced with the same or similar reference numerals.

As used herein, directional terms, such as "above," "below," "up," "down," "upward," "downward," "top," "bottom," "upper," "lower," "top-most," "bottom-most," and the like, are to be interpreted from a reference point of the object so described as such object is located in a vertical wellbore, regardless of the actual orientation of the object so described. For example, the terms "above," "up," "upward," "upper," "top," "top-most," and the like, are synonymous with the term "uphole," as such term is understood in the art of subterranean wellbore drilling. Similarly, the terms "below," "down," "lower," "downward," "bottom," "bottom-most," and the like are synonymous with the term "downhole," as such term is understood in the art of subterranean wellbore drilling.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the term "and/or" includes any and all combinations of one or more of the associated listed items.

Figure 19:
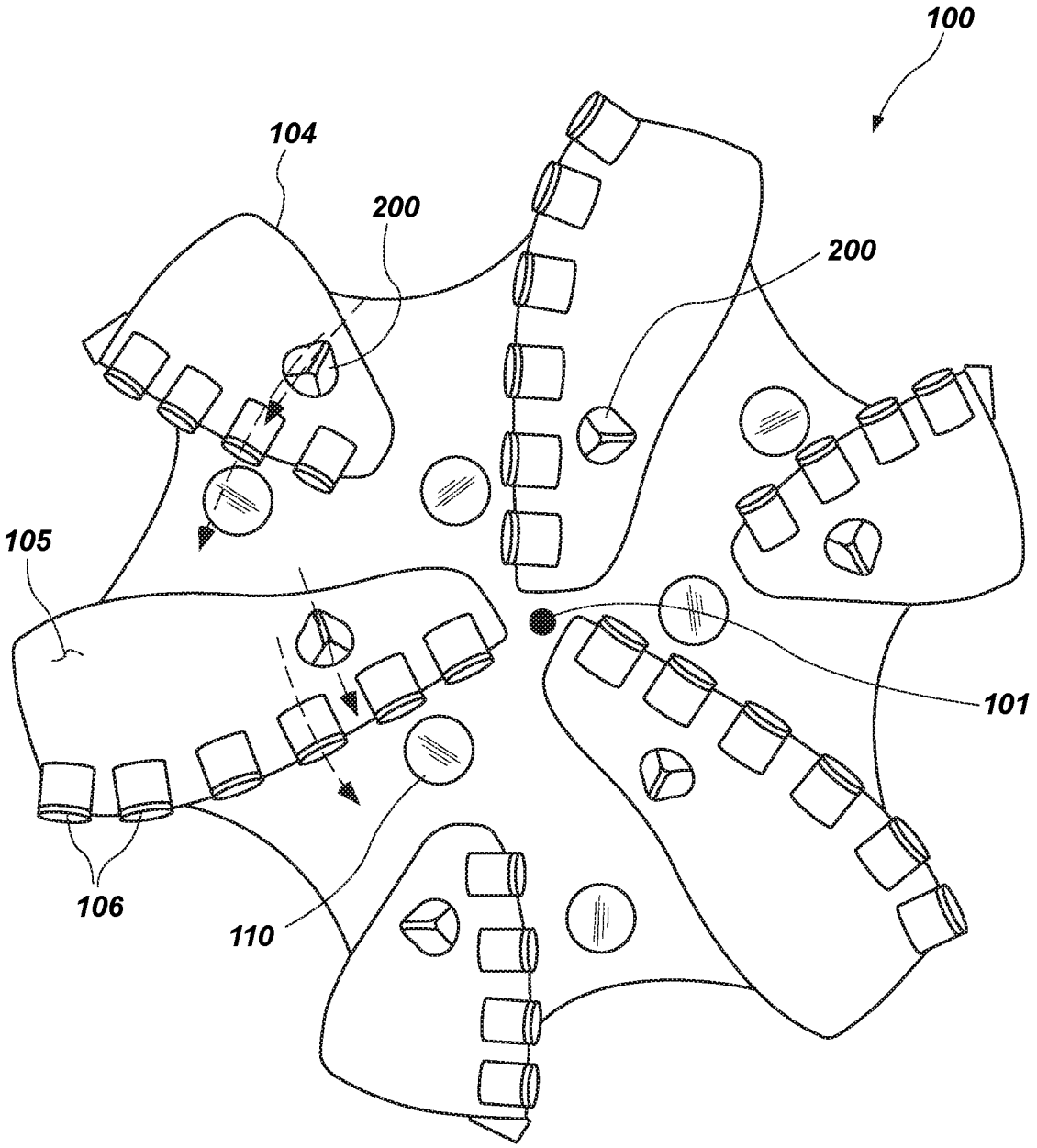
FIG. 19 is a face view of a drill bit having depth of cut control features according to embodiments of the present disclosure mounted thereon.

As used herein, the term "rotationally behind" means rotationally following a cutting element, but not necessarily following in the same path. For example, as illustrated in FIG. 19, a depth of cut control feature described as located "rotationally behind" a cutting element on a blade shall mean a depth of cut control feature that is located rearwardly of the cutting element on the blade but may be located at the same or different radial distance from a central axis of the bit than a radial distance at which the cutting element is located on the blade such that the cutting element and the depth of cut control feature may have the same or different rotational path (indicated by the directional arrows).

As used herein, the term "earth-boring tool" means and includes any tool used to remove formation material and to form a bore (e.g., a wellbore) through a subterranean formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

As used herein, the term "cutting element" means and includes any element of an earth-boring tool that is used to cut or otherwise disintegrate material of a subterranean formation when the earth-boring tool is used to form or enlarge a bore in the formation.

FIG. 1 illustrates an example of a fixed-cutter earth-boring rotary drill bit 100 that may be designed and fabricated in accordance with embodiments of the present disclosure. The drill bit 100 includes a bit body 102 having a central axis 101 about which the drill bit 100 rotates in operation. The bit body 102 comprises a plurality of blades 104 extending radially outward from proximate the central axis 101 toward a gage 107 of the bit body 102. In the embodiment of FIG. 1, the bit body 102 has six blades 104, although in other embodiments the bit body 102 may have more or fewer blades 104. Outer surfaces of the blades 104 may define at least a portion of what is referred to in the art as the "face" of the drill bit 100.

A row of cutting elements 106 may be mounted to the blade 104 of the drill bit 100. For example, cutting element pockets may be formed in the blades 104, and the cutting elements 106 may be positioned in the cutting element pockets and bonded (e.g., brazed, welded, etc.) to the blades 104. The cutting elements 106 may comprise, for example, a polycrystalline compact in the form of a layer of hard polycrystalline material, also known in the art as a polycrystalline table, that is provided on (e.g., formed on or attached to) a supporting substrate with an interface therebetween. In some embodiments, the cutting elements 106 may comprise polycrystalline diamond compact (PDC) cutting elements each including a volume of polycrystalline diamond material provided on a ceramic-metal composite material substrate, as is known in the art. Though the cutting elements 106 in the embodiment depicted in FIG. 1 are cylindrical or disc-shaped, the cutting elements 106 may have any desirable shape, such as a dome, cone, chisel, etc.

The drill bit 100 includes a connection portion 108, which is commonly characterized as a "shank" and which may comprise, for example, a threaded pin connection conforming to specifications of the American Petroleum Institute (API) and configured for attachment to drill pipe or other component of a bottom hole assembly. In other embodiments, the drill bit 100 may comprise a casing bit configured to be attached to a section of wellbore casing or liner for drilling with the casing or liner.

The bit body 102 includes an inner plenum, access to which may be provided through the connection portion 108. Fluid passageways may extend from the inner plenum to fluid ports 110 at the face of the drill bit. During drilling, the drill bit 100 may be rotated at the bottom of the wellbore while drilling fluid is pumped through the bit body and out of the fluid ports 110 (which may have fluid nozzles affixed therein). The drilling fluid carries formation cuttings generated by the cutting elements 106 away from the cutting elements and up through the wellbore in the annulus between the drill string and the formation to the surface. The drilling fluid also may serve to cool the cutting elements 106 during drilling.

In some embodiments, the bit body 102 may include depth of cut control (DOCC) features 103 mounted thereon. The DOCC features 103 may be used for limiting a depth of cut of the cutting elements 106 during drilling. The DOCC features 103 may be mounted on the blades 104. The DOCC features 103 may be located rotationally behind the row of cutting elements 106 mounted on those blades 104. The DOCC features 103 may be integrally formed with the blades 104, or they may comprise separately formed inserts that are secured to the blades 104 by brazing, press-fitting, or other conventional technique.

Figure 2:
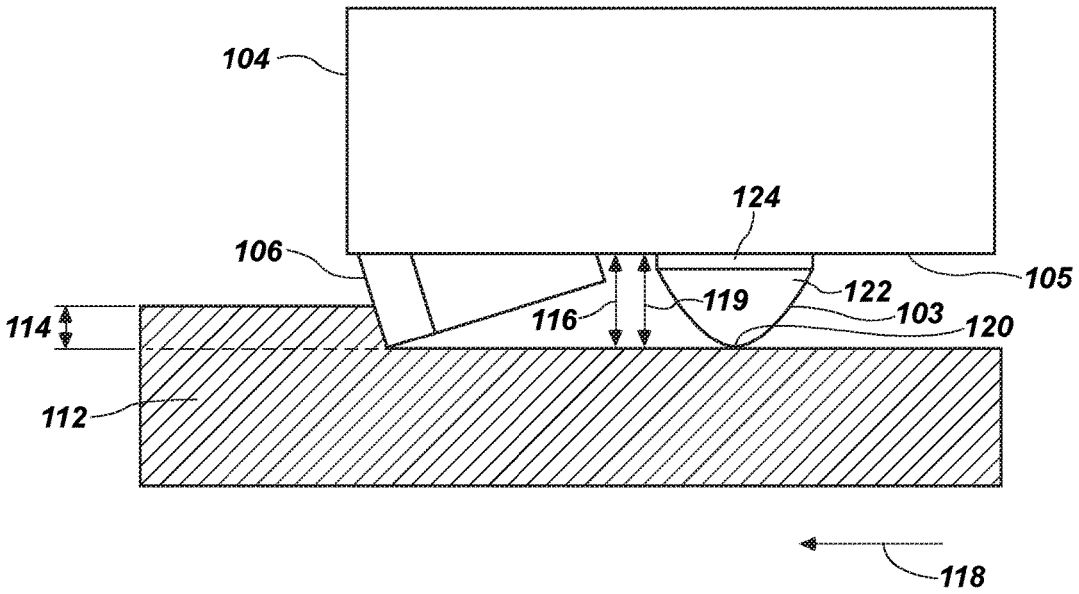
FIG. 2 is a simplified illustration of a cutting element and a depth of cut control feature engaging a formation.

FIG. 2 schematically illustrates cutting element 106 and DOCC feature 103 carried by the blade 104 engaging a subterranean formation 112 as the bit 100 (not shown) rotates in a direction indicated by arrow 118. The cutting elements 106 and the bit body 102 may be configured such that each cutting element 106 has a respective exposure relative to the bit body 102. An exposure 116 of each cutting element 106 may be defined as the maximum distance to which the cutting element 106 may extend into the formation before a surface 105 of the blade 104 to which the cutting element 106 is mounted begins to ride or rub on the formation 112. In other words, the exposure 116 of the cutting element 106 may be defined by a distance that the cutting element 106 extends or projects over the surface 105 of the blade 104 to which it is mounted. The cutting element 106 also has a depth of cut 114, which may differ from the exposure 116. The depth of cut 114 of the cutting element 106 may extend over a range and may depend upon the exposure of the cutting element 106 relative to an exposure 119 of the DOCC feature 103, as illustrated in FIG. 2, the applied WOB, the speed at which the bit 100 rotates (generally measured in rotations per minute), and the hardness of the formation 112 with which the cutting element 106 is engaged, among other drilling parameters. At the depth of cut 114 illustrated in FIG. 2, a rubbing surface 120 of the DOCC feature 103 begins to ride or rub on the formation 112 and prohibits or slows down further extension of the cutting element 106 into the formation 112. Depth of cut, for purposes of describing embodiments of the present disclosure, may be expressed in terms of millimeters or fractions of an inch by which a cutting element 106 of drill bit 100 is advanced into the formation 112 per revolution of the drill bit 100.

Figure 3:
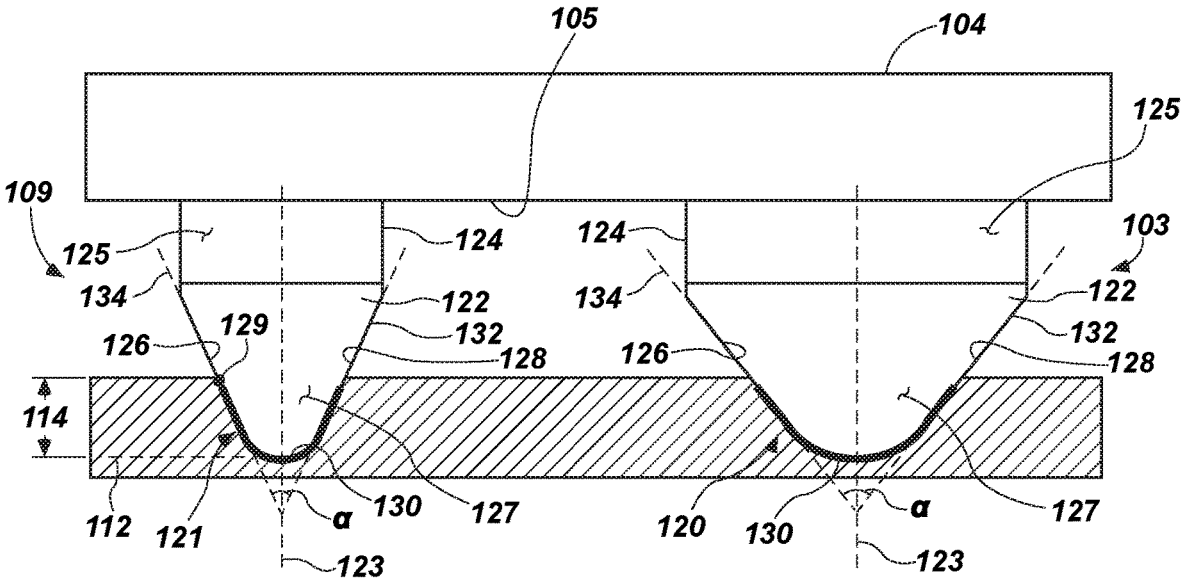
FIG. 3 is a simplified illustration of depth of cut control features engaging a formation according to embodiments of the present disclosure.

FIG. 3 is a schematic illustration of a side view of the DOCC feature 103 and a DOCC feature 109 engaging the subterranean formation 112 in a direction of rotation extending into the page. The DOCC features 103, 109 shown in FIG. 3 may be attached to the same (e.g., common) blade 104 and may be located radially adjacent to each other. For instance, the DOCC features 103, 109 may be mounted on the blade 104 in a row rotationally behind the row of cutting elements 106. In other embodiments, the DOCC features 103, 109 may be attached to different blades 104 and may be located at different radial positions relative to the central axis 101 of the bit 100.

Each of the DOCC features 103, 109 may comprise a longitudinal axis 123, a base 124, and a tip 122 provided on the base 124. The base 124 may have a substantially cylindrical shape. The longitudinal axis 123 may extend through a center of the base 124 such that the longitudinal axis 123 extends substantially parallel to a peripheral sidewall 125 of the base 124. The tip 122 may comprise a peripheral sidewall 127 continuous with the peripheral sidewall 125 of the base 124 and extending inwardly from the base 124 toward a longitudinal end 130 of the tip 122. In some embodiments, the DOCC features 103, 109 may comprise tungsten carbide inserts. In other embodiments, the DOCC features 103, 109 may comprise a table of superabrasive material forming the tip 122 provided on the base 124.

As illustrated in FIG. 3, the DOCC features 103, 109 may extend (e.g. project) over the surface 105 of the blade 104 by substantially the same distance (e.g., having the substantially the same exposure 119). In other embodiments, the DOCC features 103, 109 may project over the surface 105 of the blade 104 by different distances such that the DOCC features 103, 109 have different exposures. In some embodiments, the DOCC features 103, 109 may be mounted to the blade 104 such that the DOCC features 103, 109 engage the subterranean formation 112 at substantially the same depth of cut 114. In FIG. 3, the DOCC features 103, 109 extend to the substantially the same depth into the subterranean formation 112 with which the DOCC features 103, 109 are engaged. The portion of the surface area of DOCC features 103, 109 in contact with the subterranean formation 112 may be referred to as a rubbing surface 120, 121, respectively. Rubbing surfaces 120, 121 may also be referred to in the art as a "bearing surface." In some embodiments, the rubbing surface 120, 121 comprises the longitudinal end 130 and at least a portion of the peripheral sidewall 127 of the tip 122. The rubbing surfaces 120, 121 may have a sufficient surface area to withstand the weight on bit (WOB) applied to the bit 100 without exceeding the compressive strength of the formation 112 being drilling and such that the depth of cut 114 of the cutting elements 106 may be controlled or limited.

The portion of the peripheral sidewall 127 forming part of the rubbing surface 120, 121 extends inwardly toward the longitudinal end 130 to form an included angle $\alpha$. The included angle $\alpha$ may be formed by lines tangent to surfaces of this portion of the peripheral sidewall 127 converging toward the longitudinal end 130. The tangent lines may intersect the longitudinal axis 123 over the longitudinal end 130. As illustrated in FIG. 3, the included angle $\alpha$ is an angle measured between a line 132 tangent to a first surface of the peripheral sidewall 127 at a point 129 indicating a selected depth of cut (e.g., depth to which the tip 122 of the DOCC feature extends into the formation 112 under the applied WOB) and a line 134 tangent to a second surface of the peripheral sidewall 127 of the tip 122 at the selected depth of cut. In some embodiments, the included angle $\alpha$ refers to the angle measured between the line 132 tangent to a surface 126 of the peripheral sidewall 127 extending toward the central axis 101 of the bit 100 (FIG. 1) and the line 134 tangent to a surface 128 of the peripheral sidewall 127 extending toward the gage 107 of the bit 100 (FIG. 1) at the selected point 129 when the DOCC features 103, 109 are mounted on the blade 104. In other embodiments, the peripheral sidewall 127 may be symmetrical about the central axis 123 such that the included angle $\alpha$ may be the same in a direction of rotation of the drill bit 100 such as between a rotationally leading surface and a rotationally trailing surface of the peripheral sidewall 127 of the tip 122.

According to embodiments of the present disclosure, the included angle $\alpha$ may be selected to manipulate the surface area of the rubbing surface 120, 121 of the DOCC features 103, 109 in contact with the subterranean formation 112 at a selected depth of cut 114. As previously discussed, the DOCC features 103, 109 may have substantially the same exposure 119 over the surface 105 of the blade 104 and/or may extend substantially the same distance into the subterranean formation 112. Each of the DOCC features 103, 109 may also have substantially the same shape and, as illustrated in FIG. 3, each of the DOCC features 103, 109 comprises a substantially conical-shaped tip 122. As can be appreciated by comparing the DOCC features 103 and 109 in FIG. 3, the DOCC feature 103 has a greater included angle α relative to the included angle α of the DOCC feature 109. By virtue of the difference between the included angles α, a surface area of the rubbing surface 120 of the DOCC feature 103 is greater than a surface area of the rubbing surface 121 of the DOCC feature 109 at the same depth of cut. As a result, as the DOCC features 103, 109 engage the subterranean formation 112, the DOCC features 103, 109 may take on load attributable to WOB and distribute the load over the rubbing surface 120, 121 of the DOCC feature 103, 109 (and other components of the bit 100 in contact with the formation 112, such as cutting elements 106) at different rates. For instance, the DOCC feature 103 takes up a greater percentage of WOB applied to the bit 100 compared to the DOCC feature 109 at the same depth of cut 114. In other words, by varying the included angle α between the DOCC features 103, 109, the bit 100 may be selectively designed with DOCC features 103, 109 having different rates of engagement of the rubbing surface 120, 121 per depth of cut 114. As used herein, the term "rate of engagement" means the rapidity of a DOCC feature supporting WOB after contacting the formation relative to the rapidity of another DOCC feature also supporting WOB after contacting the formation.

Further, given the same WOB applied to each of the DOCC features 103, 109, the DOCC feature 103 having the larger included angle α and, thus, the larger surface area of the rubbing surface 120 resists entering the subterranean formation 112 at a greater rate than the DOCC feature 109 having the smaller included angle α and, thus, the smaller surface of area of the rubbing surface 121. As a result, the DOCC feature 103 may limit the depth of cut 114 of the cutting element 106 more quickly and limit aggressiveness of the bit 100 more rapidly than the DOCC feature 109. In view of the foregoing, according to embodiments of the present disclosure, the bit 100 may be designed or selected to comprise a plurality of DOCC features having varying included angles α to control the rate of engagement of the DOCC features with the subterranean formation 112 including the rate at which the DOCC features 103, 109 take on and distribute load attributable to WOB and the rate at which the DOCC features limit the depth of cut of the bit 100.

According to additional embodiments of the present disclosure, the surface area of the rubbing surface of the DOCC features and, thus, the rate of engagement of the DOCC features may be manipulated by selectively varying the shape of the tip of the DOCC features. The shape of the tip of at least one DOCC feature relative to at least one other DOCC feature may be varied in addition to or as an alternative to varying the included angle. According to further embodiments, the surface area of the rubbing surface of the DOCC features in contact with the formation and, thus, the rate of engagement of at least one DOCC feature relative to at least one other DOCC feature may be manipulated by selectively varying the exposure of at least one DOCC feature relative to at least one other DOCC feature in addition to or as an alternative to varying the shape of the tip and/or the included angle. According to yet further embodiments, the surface area of the rubbing surface of the DOCC features in contact with the formation and, thus, the rate of engagement of the DOCC features may be manipulated by selectively varying a back rake angle and/or side rake angle at which the DOCC features are mounted to the earth-boring tool.

Figure 4:
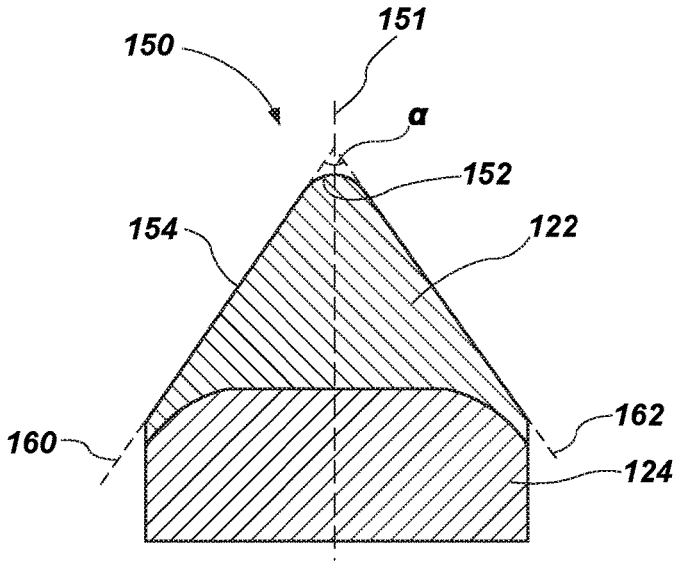
FIGS. 4-6 illustrate depth of cut control features having a conical-shaped tip according to embodiments of the present disclosure.
Figure 5:
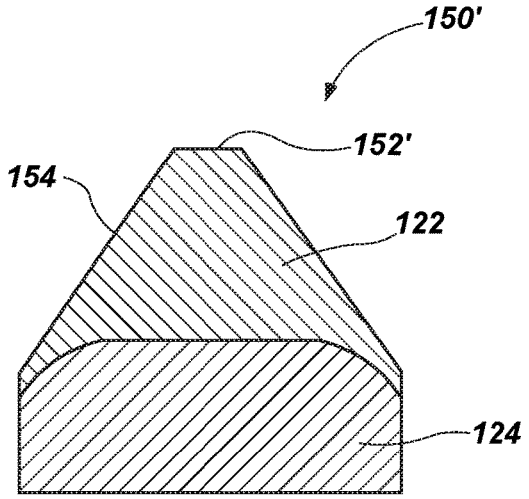
Figure 6:
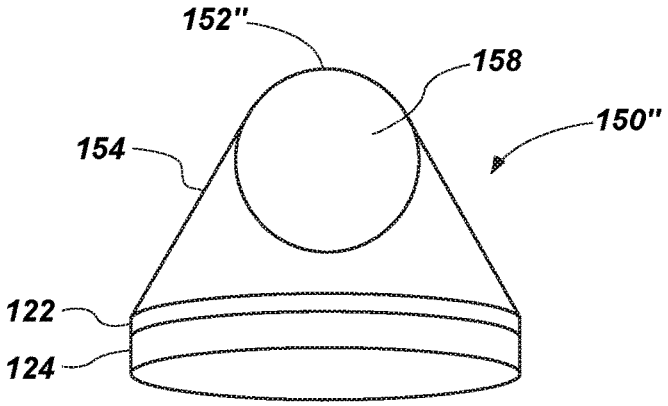

FIGS. 4 and 5 illustrate schematic cross-sectional views of DOCC features, and FIG. 6 illustrates a perspective view of a DOCC feature comprising a tip 122 having a substantially conical peripheral sidewall 154 extending inward from the base 124 toward the longitudinal end 152, 152', 152". In some embodiments, the longitudinal end 152 may have a rounded (e.g., convex) shape, as illustrated in FIG. 4, such that the DOCC feature 150 comprises a substantially pointed rubbing surface, which includes at least a portion of the conical peripheral sidewall 154 and the longitudinal end 152. In other embodiments, as illustrated in FIG. 5, the longitudinal end 152' of the DOCC feature 150' may have a substantially planar (e.g., flat) shape such that the DOCC feature 150' comprises an at least partially blunt rubbing surface, which includes the conical peripheral sidewall 154 and the longitudinal end 152'. In yet other embodiments, as illustrated in FIG. 6, the peripheral sidewall 154 of the tip 122 of the DOCC feature 150" may comprise a flat surface 158 along a portion of the conical peripheral sidewall 154. The flat surface 158 may form a rotationally leading surface of the DOCC feature 150". By way of example and not limitation, the DOCC feature 150" may have a shape such as the shape of the shaped inserts as described in U.S. Pat. No. 8,505,634, entitled "Earth-Boring Tools Having Differing Cutting Elements on a Blade and Related Methods," issued Aug. 13, 2013, U.S. Pat. No. 8,794,356, entitled "Shaped Cutting Elements on Drill Bits and Other Earth-Boring Tools, and Methods of Forming Same," issued Aug. 5, 2014, and/or U.S. Pat. No. 9,022,149, entitled "Shaped Cutting Elements for Earth-Boring Tools, Earth-boring Tools Including Such Cutting Elements, and Related Methods," issued May 5, 2015, the entire disclosure of each of which is incorporated herein by this reference.

As previously explained with reference to the conical DOCC features 103, 109 of FIG. 3 and as illustrated in FIG. 4, an included angle α may be formed at an intersection of a line 160 tangent to a first surface of the portion of the peripheral sidewall 154 forming part of the rubbing surface and a line 162 tangent to the second surface of the portion of the peripheral sidewall 154 forming part of the rubbing surface and converging toward the first surface such that the tangent lines 160, 162 intersect with a central axis 151 over the longitudinal end 152. As illustrated in FIG. 4, the included angle α may remain substantially constant at different depths of cut (e.g., at different depths to which the DOCC feature 150 extends into the formation).

Figure 7:
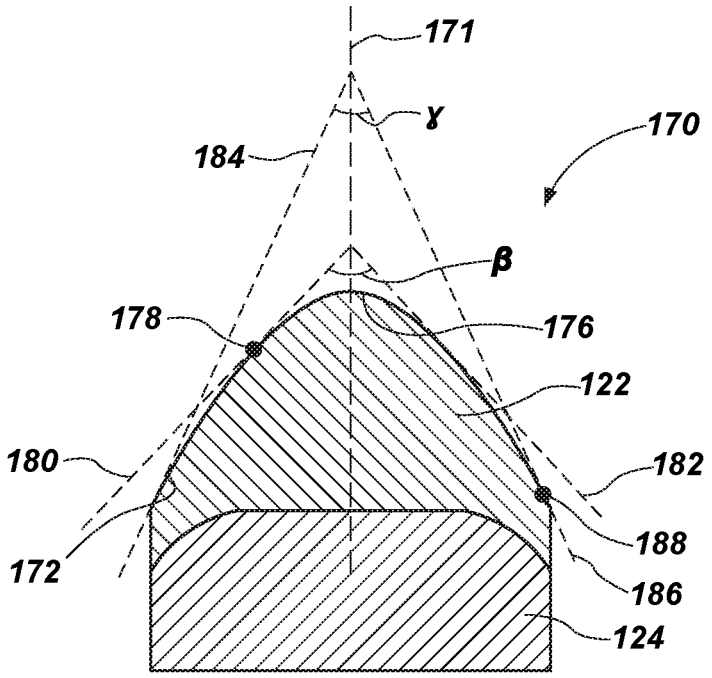
FIGS. 7 and 8 illustrate depth of cut control features having a dome-shaped tip according to embodiments of the present disclosure.
Figure 8:
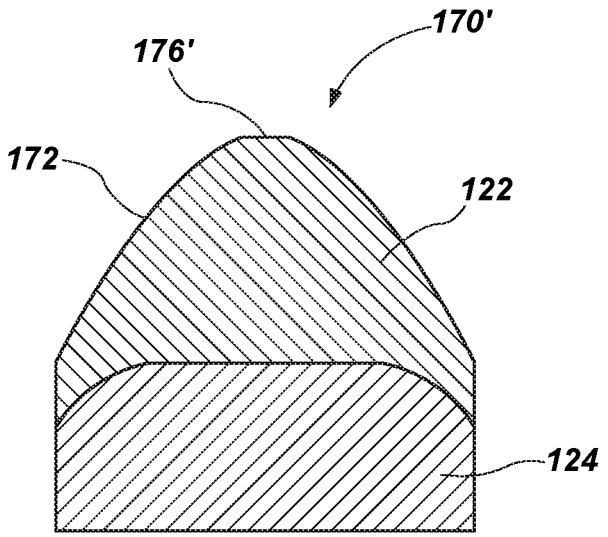

FIGS. 7 and 8 illustrate schematic cross-sectional views of DOCC features 170, 170', respectively, comprising a tip 122 having a substantially hemispherical or dome shape. As illustrated in FIG. 7, the tip 122 may comprise a peripheral sidewall 172 extending inward from the base 124 toward a longitudinal end 176. In some embodiments, the longitudinal end 176 may have a rounded shape, as illustrated in FIG. 7, such that the DOCC feature 170 may have a substantially pointed rubbing surface including the longitudinal end 176 and a portion of the peripheral sidewall 172. In other embodiments, as illustrated in FIG. 8, the DOCC feature 170' may have a substantially planar longitudinal end 176' such that the DOCC feature 170' may comprise an at least partially blunt rubbing surface including the longitudinal end 176' and a portion of the peripheral sidewall 172. By way of example and not limitation, the DOCC feature 170' may have a shape such as the shape of a shaped insert substantially as described in U.S. Pat. Nos. 8,505,634, 8,794,356, and 9,022,149, previously incorporated herein by reference.

As illustrated in FIG. 7, the included angle formed by lines tangent to surfaces of the peripheral sidewall 172 of the tip 122 may vary at different depths of cut (e.g., at different depths to which the DOCC feature 170 extends into the formation). For instance, a first included angle β may be formed by lines 180, 182 tangent to a first surface of the peripheral sidewall 172 and a second surface of the peripheral sidewall 172 converging toward the first surface, respectively, and inserting a central axis 171. The lines 180, 182 may be tangent to the first surface of the peripheral sidewall 172 and the second surface of the peripheral sidewall 172 at a first point 178 indicating a first depth of cut at which the DOCC feature 170 engages the subterranean formation. A second included angle γ may be formed by lines 184, 186 tangent to a first surface of the peripheral sidewall 172 and a second surface of the peripheral sidewall 172 converging toward the first surface, respectively, at a second point 188 indicating a second, greater depth of cut at which the DOCC feature 170 engages the subterranean formation. As illustrated in FIG. 7, the included angle may decrease as the depth of cut increases. In accordance with embodiments of the present disclosure, the rate at which the included angle varies may be selectively tailored to control the rate at which the DOCC feature 170 takes on and distributes WOB over the rubbing surface as the depth of cut increases with increasing applied WOB.

Figure 9:
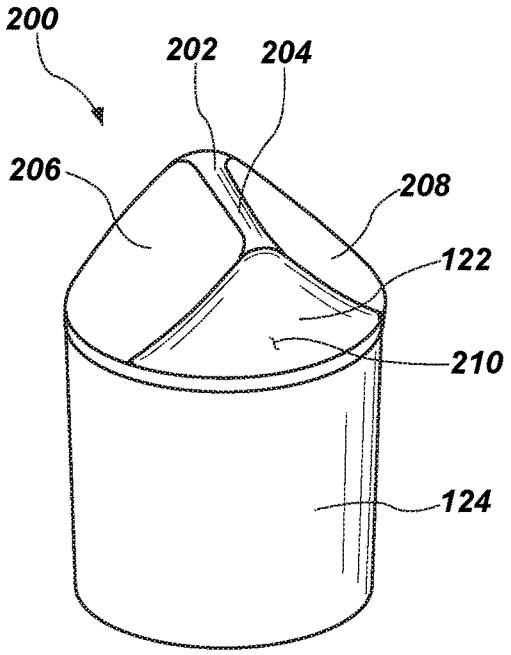
FIGS. 9-11 illustrate depth of cut control features having a chisel-shaped tip according to embodiments of the present disclosure.
Figure 10:
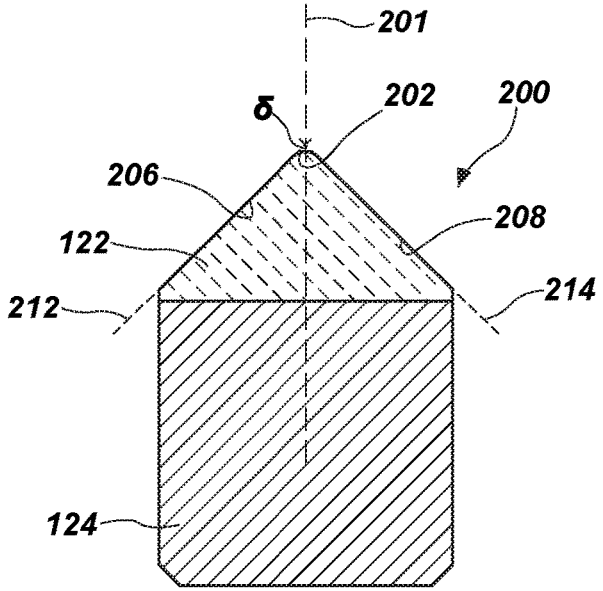
Figure 11:
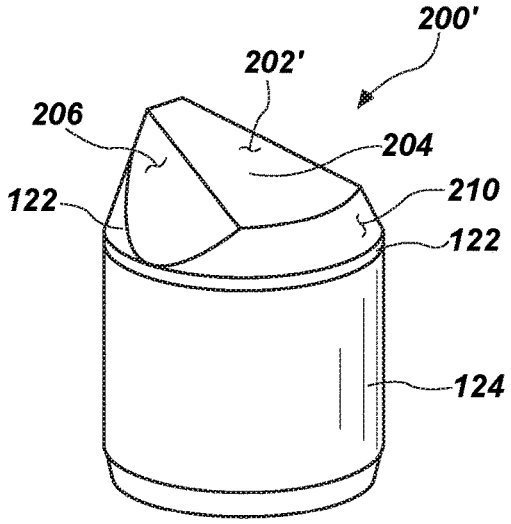

FIGS. 9, 10, and 11 illustrate a perspective view, a schematic cross-sectional view, and a perspective view, respectively, of DOCC features having chisel-shaped tips 122 according to embodiments of the present disclosure. As illustrated in FIG. 9, the tip 122 of the DOCC feature 200 may comprise a curved crest 202 located generally at an longitudinal end 204 of the tip 122 such that the DOCC feature 200 comprises a substantially pointed rubbing surface. A first substantially planar flank 206 may be positioned on a first side of the crest 202 and a second substantially planar flank 208 may be positioned on an opposite side of the crest 202. A first cylindrical portion (not shown) and a second cylindrical portion 210 may be located between the first substantially planar flank 206 and the second substantially planar flank 208 on opposite sides of the crest 202. In other embodiments, as illustrated in FIG. 11, the DOCC feature 200' may comprise a flat crest 202' located generally at the longitudinal end 204 of the tip 122 such that the DOCC feature 200' may comprise an at least partially blunt rubbing surface. By way of example and not limitation, the DOCC feature 200' of FIG. 11 may have a shape such as the shape of the shaped insert substantially as described in U.S. Pat. No. 9,074,435, entitled "Earth-Boring Tools Having Shaped Cutting Elements," issued Jul. 7, 2015, the entire disclosure of which is incorporated herein by this reference. As illustrated in FIG. 10, an included angle δ may be formed by a line 212 tangent to the first substantially planar flank 206 and a line 214 tangent to the second substantially planar flank 208 that intersect over the longitudinal end 204 and with a central axis 201. In some embodiments, the included angle δ may be substantially constant at different depths of cut.

Figure 12:
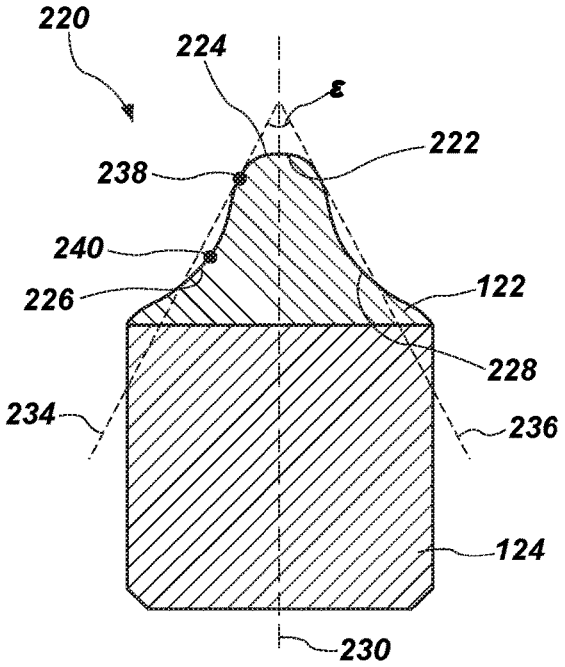
FIGS. 12 and 13 illustrate depth of cut control features having another chisel-shaped tip according to embodiments of the present disclosure.
Figure 13:
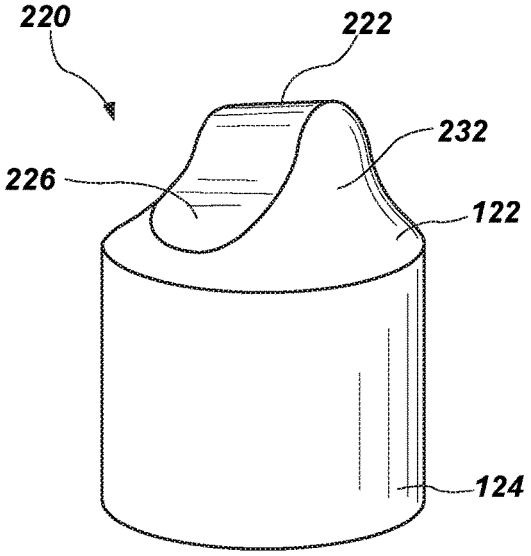

FIGS. 12 and 13 illustrate a side view and a perspective view, respectively, of a DOCC feature 220 having a chisel-shaped tip 122 according to additional embodiments of the present disclosure. Like the DOCC feature 200 of FIG. 9, the DOCC feature 220 may comprise a curved crest 222 located generally at a longitudinal end 224 of the tip 122 such that the DOCC feature 220 comprises a substantially pointed rubbing surface. A first substantially curved flank 226 may be positioned on a first side of the crest 222 and a second substantially curved flank 228 may be positioned on an opposite side of the crest 222. In some embodiments, the first and second curved flanks 226, 228 may be concave such that the curved flanks 226, 228 extend inward toward a central axis 230 of the DOCC feature 220. A first substantially conical portion (not shown) and a second substantially conical portion 232 may be located between the first and second curved flanks 226, 228 on opposite sides of the crest 222. As illustrated in FIG. 12, an included angle c may be formed by lines 234, 236 tangent to the first and second curved flanks 226, 228, respectively, at a first point 238 indicating a first depth of cut at which the DOCC feature 220 engages the subterranean formation and intersecting at the central axis 230. In some embodiments, the included angle c may vary at different depths of cut. For example, as the depth of cut increases beyond the first point 238, the included angle of the DOCC feature 220 may decrease up to a depth at which the radially innermost point 240 of the concave curved flanks 226, 228 forms a part of the rubbing surface of the DOCC feature 220 engaged with the formation and may subsequently increase at depths of cut beyond the radially innermost point 240.

Figure 14:
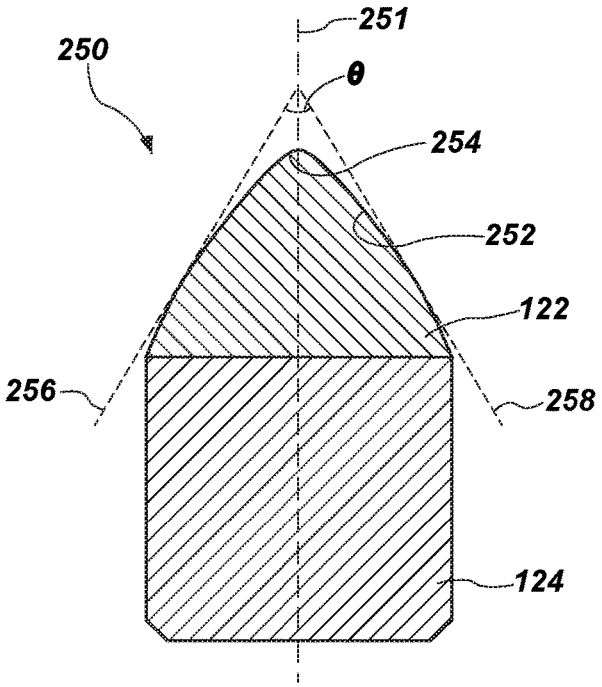
FIGS. 14 and 15 illustrate depth of cut control features having a parabolic-shaped tip with an elliptical-shaped tip.
Figure 15:
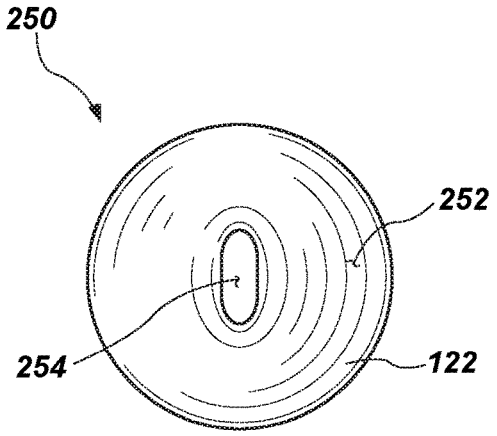

FIGS. 14 and 15 illustrate a side view and a top view, respectively, of a DOCC feature 250 having an elliptical paraboloid-shaped tip 122 according to embodiments of the present disclosure. As best shown in the top view of FIG. 15, the DOCC feature 250 may comprise a peripheral sidewall 252 having a substantially elliptic shape. DOCC feature 250 may also comprise a curved longitudinal end 254 such that the DOCC feature 250 comprises a substantially pointed rubbing surface. As illustrated in FIG. 14, an included angle θ may be formed by lines 256, 258 tangent to the peripheral sidewall 252 at a first depth of cut at which the DOCC feature 250 engages the subterranean formation and intersecting at the central axis 251. In some embodiments, the included angle may vary as the depth of cut increases. In other embodiments, the included angle may be substantially constant as the depth of cut increases.

In any of the foregoing embodiments, the included angles α, β, γ, δ, ε, θ may extend in a range between about 70 degrees and about 180 degrees, between about 80 degrees and about 120 degrees, between about 90 degrees and about 120 degrees, and between about 80 degrees and about 90 degrees.

Figure 16:
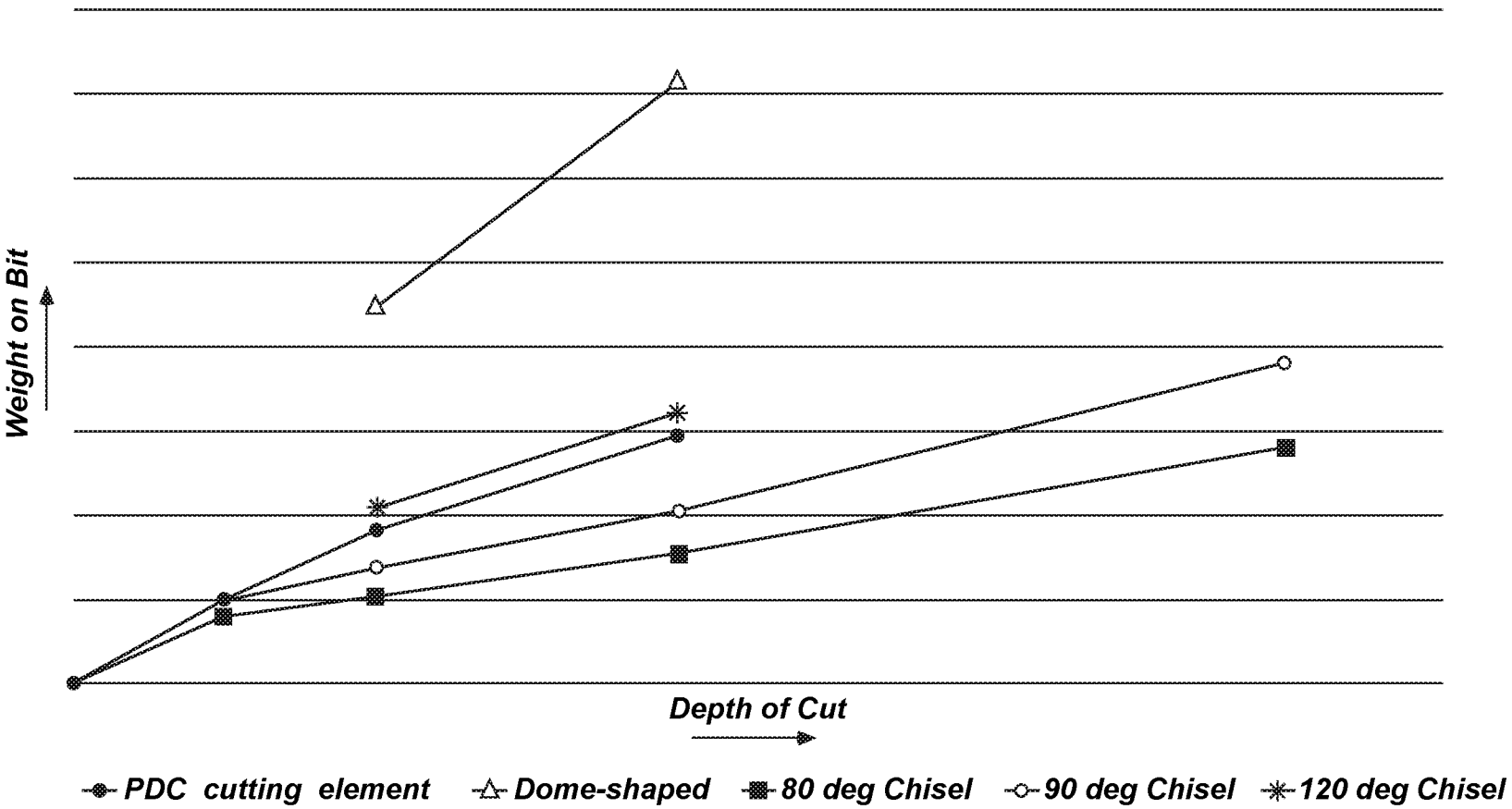
FIG. 16 is a graph illustrating the relationship between a weight on bit required to maintain a given rate-of-penetration and the shape of the depth of cut control features according to some embodiments of the present disclosure.

FIG. 16 is a graph illustrating the relationship between a load attributable to applied WOB distributed over a rubbing surface as a function of increasing depths of cut for a PDC cutting element, as previously described with regard to FIGS. 1 and 2, chisel-shaped DOCC features, as previously described with regard to FIG. 4, having a 80°, 90°, and 120° included angle, respectively, and a dome-shaped DOCC feature, as previously described with regard to FIG. 7. As illustrated in FIG. 16, the dome-shaped DOCC feature takes on a different load attributable to WOB compared to the chisel-shaped DOCC features and the PDC cutting element at a given (e.g., same) depth of cut and, accordingly, engages the subterranean formation at a different rate than the DOCC features and the PDC cutting element. For instance, the dome-shaped DOCC feature is mathematically predicted to take on a greater load attributable to WOB than the chisel-shaped DOCC features and the PDC cutting element. As further illustrated in FIG. 16, the DOCC features having the same chisel shape but different included angle take on a different load attributable to WOB at a given depth of cut. In particular, the chisel-shaped DOCC feature having the greatest included angle (e.g., the chisel-shaped DOCC feature having a 120° included angle) takes on the greatest load attributable to WOB relative to other chisel-shaped DOCC features having lesser included angles. In addition, the rate at which the DOCC features take on load attributable to WOB as the depth of cut increases varies as function of shape and/or included angle of the tip of the DOCC feature.

Figure 17:
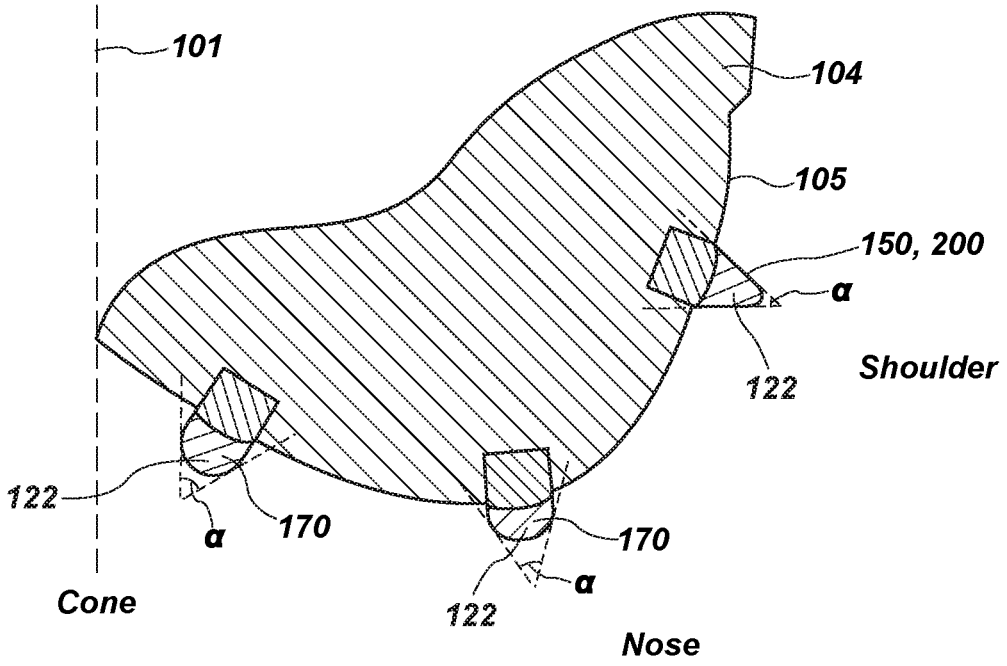
FIGS. 17 and 18 are schematic partial side cross-sectional views of a bit body including depth of cut control features according to embodiments of the present disclosure.
Figure 18:
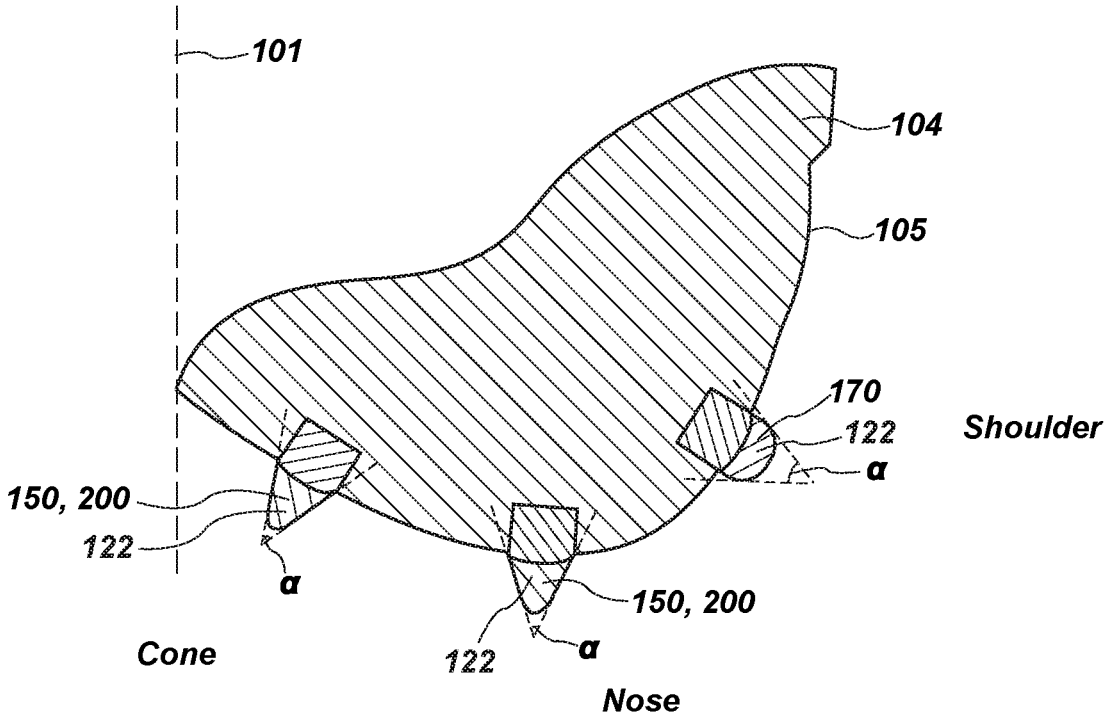

According to embodiments of the present disclosure, DOCC features having at least one of a different shape, different included angle, different exposure, and different back rack and/or side rake angle may be carried on the earth-boring tool and may be mounted on the bit body 102 such that the rate at which the DOCC features take on and distribute load attributable to WOB over a rubbing surface may be varied across the face of the bit body 102. FIGS. 17 and 18 illustrate a schematic, partial cross-sectional view of the bit body 102, as if each of the DOCC features disposed thereon were rotated onto a single blade 104 protruding from the bit body 102. However, as illustrated in FIG. 19, the DOCC features may be disposed on different blades 104. The blade 104 may comprise a cone region, a nose region, and a shoulder region between the central axis 101 and the gage 107 of the bit 100.

With continued reference to FIGS. 17 and 18, the drill bit 100 may comprise at least one DOCC feature having an included angle different from an included angle of at least one other DOCC feature. In some embodiments, the included angles α of the DOCC features may vary along a profile of the blade 104 such that the included angle α may be greater in at least one of the cone region, the nose region, and the shoulder region than in another of the cone region, the nose region, and the shoulder region. By way of example and not limitation, the included angle α of the DOCC features 150, 170, 200 may decrease between the cone region, the nose region, and the shoulder region, respectively, as illustrated in FIG. 17. As a result, the DOCC features located in the cone region may distribute the load attribute to WOB over the rubbing surface thereof or limit the depth of cut of the bit 100 at a greater rate than the DOCC features located in the either the nose or shoulder regions. In other embodiments, the included angle α may increase between the cone region, the nose region, and the shoulder region, as illustrated in FIG. 18. As a result, the DOCC features 170 located in the shoulder region may distribute the load attribute to WOB over the rubbing surface thereof or limit the depth of cut of the bit 100 at a greater rate than the DOCC features 150, 200 located in either the cone or nose regions.

Alternatively or additionally, the bit 100 may comprise DOCC features having tips 122 having one or more shapes. For example, the shape of the table of the DOCC features may vary along the profile of the blade 104 such that the DOCC features mounted in at least one of the cone region, the nose region, and the shoulder region may have a shape different that the DOCC features mounted in another of the cone region, the nose region, and the shoulder region. As illustrated in FIG. 17, the cone region and nose region may be selected to comprise DOCC features 170 having the hemispherical-shaped tip 122, as previously discussed with regard to FIGS. 7 and 8, and the shoulder region may be selected to comprise DOCC features 200 having a chisel-shaped tip 122, as previously discussed with regard to FIGS. 9-11, and/or DOCC features 150 having a conical-shaped tip 122, as previously discussed with regard to FIGS. 4-6. In other embodiments, the cone region and nose region may be selected to comprise DOCC features 200 having a chisel-shaped tip 122 and/or DOCC features 150 having a conical-shaped tip 122, and the shoulder region may be selected to comprise DOCC features 170 having the hemispherical-shaped tip 122. With reference to FIG. 19, in some embodiments the drill bit 100 may comprise DOCC features, such as chisel-shaped DOCC features 200, mounted to the blade 104 in a common region of the blade profile and having at least one of a varied included angle, shape, exposure, and back rake and/or side rake angle.

According to further embodiments of the present disclosure, DOCC features having one or more of substantially the same shape, included angle, exposure, back rake angle, and/or side rake angle and, in some embodiments, DOCC features having each of substantially the same shape, included angle, exposure, back rake angle, and side rake angle may be carried on the earth-boring tool and may be mounted on the bit body 102. In such embodiments, one or more of and, more particularly, each of the shape, included angle, exposure, back rake angle, and/or side rake angle may be selected to be substantially the same across the face of the bit 100 and in each region of the blade 104 in which DOCC features may be mounted. Further, each of the DOCC features mounted to the bit 100 may distribute a load attributable to applied weight on bit 100 at substantially the same rate of engagement. Therefore, the DOCC features may be tailored such that the rate at which the DOCC features take on and distribute load attributable to WOB over a rubbing surface may be selectively tailored for the bit 100. Thus, DOCC features may be selected to customize or adapt the depth of cut control and, more particularly, the rate of engagement for different drilling applications, including different formation material that may be encountered, without substantially changing the design of the bit 100.

As previously described herein, by varying and/or tailoring the shape of the tip 122 and/or the included angle of the DOCC features on the face of the bit 100, the rate at which the DOCC features engage the subterranean formation and distribute load attribute to applied WOB, as previously described, may be selectively controlled. Furthermore, by controlling the rate at which the DOCC features mounted to the bit 100 engage the formation, stick-slip vibrations may be avoided. Accordingly, in additional embodiments of the present disclosure, the DOCC features may be designed such that the DOCC features are interchangeable and may be replaced or repaired without necessitating a redesign of the bit 100. For example, the bit 100 may be modified such that at least one of the DOCC features 103, 109 is removed from the blade 104. In the place of the removed DOCC feature, a new DOCC feature having a surface area of a rubbing surface thereon different from the removed DOCC feature and the DOCC feature remaining on the blade may be mounted on the blade. Thus, DOCC features having different included angles α and/or different shapes may be selected to customize or adapt the depth of cut control and, more particularly, the rate of engagement of the DOCC features with the formation such that the bit 100 may be customized or adapted for different drilling applications, including different formation material that may be encountered, without substantially changing the design of the bit 100.

While the disclosed structures and methods are susceptible to various modifications and alternative forms in implementation thereof, specific embodiments have been shown by way of example in the drawings and have been described in detail herein. However, it should be understood that the present disclosure is not limited to the particular forms disclosed. Rather, the present invention encompasses all modifications, combinations, equivalents, variations, and alternatives falling within the scope of the present disclosure as defined by the following appended claims and their legal equivalents.

What is claimed is:

1. An earth-boring tool for drilling subterranean formations, comprising:

a bit body having a central axis;

a first depth of cut control ("DOCC") feature mounted on the bit body, the first DOCC feature comprising a first rubbing surface having a first surface area for contacting a subterranean formation and distributing a load attributable to applied weight on bit at a first rate, the first rubbing surface comprising a longitudinal end and a portion of a peripheral sidewall extending inwardly toward the longitudinal end of the first DOCC feature, the peripheral sidewall of the first rubbing surface forming a first included angle over the longitudinal end, the first included angle formed by a line tangent a first surface of the peripheral sidewall and a line tangent a second surface of the peripheral sidewall converging toward the first surface of the peripheral sidewall and intersecting at a longitudinal axis of the first DOCC feature; and a second DOCC feature mounted on the bit body, the second DOCC feature comprising a second rubbing surface having a second surface area for contacting the subterranean formation and distributing the load attributable to the applied weight on bit at a second rate, the second rubbing surface comprising a longitudinal end and a portion of a peripheral sidewall extending inwardly toward the longitudinal end of the second DOCC feature, the peripheral sidewall of the second rubbing surface forms a second included angle over the longitudinal end, the second included angle formed by a line tangent a first surface of the peripheral sidewall and a line tangent a second surface of the peripheral sidewall converging toward the first surface of the peripheral side wail and intersecting at a longitudinal axis of the second DOCC feature, the second included angle different from the first included angle when each of the first included angle and the second included angle are measured at a given depth of cut, the second surface area different from the first surface area such that the second rate is different from the first rate.

2. The earth-boring tool of claim 1, further comprising a plurality of blades extending radially outward between the central axis and a gage of the bit body, wherein the first DOCC feature is mounted on a first blade of the plurality of blades and the second DOCC feature is mounted on a second blade of the plurality of blades.

3. The earth-boring tool of claim 1, further comprising a plurality of blades extending radially outward between the central axis and a gage of the bit body, wherein the first DOCC feature and the second DOCC feature are mounted on a common blade of the plurality of blades.

4. The earth-boring tool of claim 1, wherein each of the first included angle and the second included angle extends in a range from about 70 degrees to about 180 degrees.

5. The earth-boring tool of claim 1, wherein each of the first included angle and the second included angle extends in a range from about 80 degrees to about 120 degrees.

6. The earth-boring tool of claim 1, wherein:

the first included angle of the first rubbing surface is greater than the second included angle of the second rubbing surface at the given depth of cut; and the first DOCC feature having the first rubbing surface is located radially outward relative to the second DOCC feature having the second rubbing surface on the bit body.

7. The earth-boring tool of claim 1, wherein:

the first included angle of the first rubbing surface is greater than the second included angle of the second rubbing surface at the given depth of cut; and the first DOCC feature having the first rubbing surface is located radially inward relative to the second DOCC feature having the second rubbing surface on the bit body.

8. The earth-boring tool of claim 1, wherein:

a tip including the longitudinal end and the peripheral sidewall of the first DOCC feature forms a first shape; and a tip including the longitudinal end and the peripheral sidewall of the second DOCC feature forms a second shape, the second shape different from the first shape.

9. A method of forming an earth-boring tool, comprising:

selecting a first depth of cut control ("DOCC") feature to contact a subterranean formation and distribute a load attributable to applied weight on bit over a first rubbing surface at a first rate;

selecting a second DOCC feature to contact the subterranean formation and distribute a load attributable to the applied weight on bit over a second rubbing surface at a second rate;

selecting the first rate to be greater than the second rate by:

selecting the first rubbing surface to comprise a longitudinal end and a portion of a peripheral sidewall extending inwardly toward the longitudinal end of the first DOCC feature, the peripheral sidewall forming a first included angle at a given depth of cut, wherein the first included angle is an angle measured at an intersection of a line tangent to a first surface of the peripheral sidewall and a line tangent to a second surface of the peripheral sidewall converging toward the first surface and intersecting longitudinal axis of the first DOCC feature;

selecting the second rubbing surface to comprise a longitudinal end and a portion of a peripheral sidewall extending inwardly toward the longitudinal end of the second DOCC feature, the peripheral sidewall forming a second included angle at the given depth of cut, wherein the second included angle is an angle measured at an intersection of a line tangent to a first surface of the peripheral sidewall and a line tangent to a second surface of the peripheral sidewall converging toward the first surface and intersecting a longitudinal axis of the second DOCC feature; and selecting the first included angle to be greater than the second included angle; and mounting the first DOCC feature and the second DOCC feature on a bit body.

10. The method of claim 9, wherein mounting the first DOCC feature and the second DOCC feature on the bit body comprises mounting the first DOCC feature radially inward relative to the second DOCC feature.

11. The method of claim 9, wherein mounting the first DOCC feature and the second DOCC feature on the bit body comprises mounting the first DOCC feature radially outward relative to the second DOCC feature.

12. The method of claim 9, wherein selecting the first rate to be greater than the second rate comprises selecting a surface area of the first rubbing surface to be greater than a surface area of the second rubbing surface.

13. The method of claim 9, wherein selecting the first rate to be greater than the second rate further comprises:

selecting a tip including the longitudinal end and the peripheral sidewall of the first DOCC feature to have a first shape; and selecting a tip including the longitudinal end and the peripheral sidewall of the second DOCC feature to have a second shape different from the first shape.

14. The method of claim 9, further comprising selecting each of the first included angle and the second included angle to extend in a range from about 70 degrees and about 180 degrees.

15. The method of claim 9, further comprising selecting each of the first included angle and the second included angle to extend in a range from about 80 degrees and about 120 degrees.

16. The method of claim 9, wherein selecting the first rate to be greater than the second rate comprises:

selecting a tip including the longitudinal end and the peripheral sidewall of the first DOCC feature to have a first shape; and selecting a tip including the longitudinal end and the peripheral sidewall of the second DOCC feature to have a second shape different from the first shape.

17. The method of claim 9, further comprising:

removing the first DOCC feature from the bit body;

selecting a third DOCC feature to engage the subterranean formation and distribute the load attributable to the applied weight on bit over a third rubbing surface at a third rate;

selecting the third rate to be different from the first rate and the second rate; and mounting the third DOCC feature on the bit body.

* * * * *